US007513785B2

(12) United States Patent
Kinoshita et al.

(10) Patent No.: US 7,513,785 B2
(45) Date of Patent: Apr. 7, 2009

(54) CONNECTOR STORING APPARATUS AND ELECTRONIC DEVICE

(75) Inventors: Hideki Kinoshita, Kawagoe (JP); Akira Yasaki, Kawagoe (JP); Takeshi Nishimura, Kawagoe (JP); Hitoshi Yamazaki, Kawagoe (JP); Jun Togashi, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 11/885,433

(22) PCT Filed: Feb. 28, 2006

(86) PCT No.: PCT/JP2006/303778

§ 371 (c)(1),
(2), (4) Date: Nov. 28, 2007

(87) PCT Pub. No.: WO2006/093159

PCT Pub. Date: Sep. 8, 2006

(65) Prior Publication Data

US 2008/0248666 A1 Oct. 9, 2008

(30) Foreign Application Priority Data

Mar. 1, 2005 (JP) ..... 2005-056264

(51) Int. Cl.
*H01R 13/62* (2006.01)

(52) U.S. Cl. ..... 439/159

(58) Field of Classification Search ..... 439/159, 439/160, 260, 152, 267; 360/99.05; 369/34, 369/35–38

See application file for complete search history.

(56) References Cited

U.S. PATENT DOCUMENTS

| | | | | |
|---|---|---|---|---|
| 5,674,080 | A * | 10/1997 | Takemura | 439/159 |
| 5,956,300 | A * | 9/1999 | Chigasaki | 369/30.32 |
| 6,217,358 | B1 | 4/2001 | Norizuki et al. | |
| 6,690,574 | B2 | 2/2004 | Kasahara et al. | |

FOREIGN PATENT DOCUMENTS

| | | | |
|---|---|---|---|
| JP | 63-200384 | A | 8/1988 |
| JP | 11-067346 | A | 3/1999 |
| JP | 2002-347529 | A | 12/2002 |
| JP | 2003-299549 | A | 10/2003 |
| JP | 2003-316711 | A | 11/2003 |

* cited by examiner

*Primary Examiner*—Jean F Duverne
(74) *Attorney, Agent, or Firm*—Foley & Lardner LLP

(57) ABSTRACT

A main frame supports a receiving-side connector to which a connecting-side connector is connected in movable manner toward inside. A holding unit holds the receiving-side connector that is moved to the inside. A connector biasing unit applies a biasing force toward outside to the receiving-side connector. A hold releasing unit releases a hold by the holding unit, and moves the receiving-side connector to the outside by the biasing force. A pressing-force applying unit applies, when the receiving-side connector is not moved by the biasing force, a pressing force for ejecting the receiving-side connector to the receiving-side connector.

9 Claims, 13 Drawing Sheets

CONNECTOR STORING APPARATUS AND ELECTRONIC DEVICE

TECHNICAL FIELD

The present invention relates to a connector housing device and an electronic device including the connector device.

BACKGROUND ART

Generally, an electronic device for vehicles, such as a car audio device and a car navigation device, disclosed in, for example, Patent Documents 1 and 2, is installed in an interior of a vehicle, such as a passenger car, a truck, or a bus. Furthermore, portable electronic devices that can be carried by a user, such as a laptop computer or a personal digital assistance (PDA), and the like are widely popular.

Some of such electronic devices for vehicles and portable electronic devices have a slot that allows electric connection with a specific recording medium that is formed based on a predetermined standard including shape, or have a receiving-side connector that allows electric connection with another electronic device. The above slot is for the recording medium to be inserted inside. When the recording medium is inserted, electric connection is built between the recording medium and the electronic device.

Conventionally, a few of the electronic devices for vehicles have the above slot. However, there have been used widely the electronic devices for vehicles having the receiving-side connector, which are formed based on the USB standard or the like, allowing electric connection with another electronic device as disclosed in Patent Document 2.

Patent Document 1: Japanese Patent Application Laid-open No. 2002-347529

Patent Document 2: Japanese Patent Application Laid-open No. 2003-316711

DISCLOSURE OF INVENTION

Problem to be Solved by the Invention

It is possible to have an idea of an electronic device including a connector housing device for housing the receiving-side connector in such a state that the receiving-side connector is connected to the connecting-side connector. A connecting electronic device includes a unit including the connecting-side connector and a main body of the connecting electronic device for housing a recording medium or the like. In such an electronic device, when the receiving-side connector in connected state is housed in the connector housing device, a part or entire of the main body of the connecting electronic device is housed in the connector housing device. That is, when the receiving-side connector in connected state is housed in the connector housing device, a small part of the connecting electronic device is exposed outside of the connector housing device, so that a user cannot remove the connecting electronic device from the connector housing device. To remove the connecting electronic device, the receiving-side connector that is housed in the connector housing device in connected state is required to be moved to a position where the user can disconnect the connection between the connecting-side connector and the receiving-side connector.

The main body of the connecting electronic device can have various shapes and sizes depending on shapes and sizes of the recording medium that is configured to be housed in the main body. Accordingly, it is difficult to configure able to house all types of the main body of the connecting electronic device inside. For this reason, the connector housing device is designed based on a shape and size of the main body of the most popular connecting electronic device.

However, there is a user who prepares a connecting electronic device having a main body unable to be housed in the connector housing device because of its shape and size, connects a connecting-side connector of the connecting electronic device with the receiving-side connector, and tries to squeeze the receiving-side connector in connected state into the connector housing device. The main body of the connecting electronic device along with the receiving-side connector in connected state could be partially or entirely squeezed into the connector housing device. If the main body of the connecting electronic device is squeezed into the connector housing device, there is a possibility to generate an interface between the main body of the connecting electronic device and the connector housing device. Moreover, there is a possibility that the receiving-side connector that is housed in the connector housing device in connected state cannot move to a position where the user can disconnect the connection between the connecting-side connector and the receiving-side connector.

The present invention has been achieved as one example to solve the above problems in the conventional technology and it is an object of the present invention to provide the connector housing device and the electronic device that can remove the connecting electronic device that is housed.

Means for Solving Problem

A connector housing device according to the present invention includes a receiving-side connector to which a connecting-side connector is connected from outside; a main frame that supports the receiving-side connector to which the connecting-side connector is connected, in such a manner that the receiving-side connector moves to an inside of the main frame; a holding unit that holds the receiving-side connector that is moved to the inside with respect to the main frame; a connector biasing unit that applies a biasing force in a direction of an outside of the main frame to the receiving-side connector; a hold releasing unit that releases a hold placed by the holding unit, and moves the receiving-side connector to the outside by the biasing force; and a pressing-force applying unit that applies, when the receiving-side connector is not moved by the biasing force after the hold on the receiving-side connector is released, a pressing force for ejecting the receiving-side connector to the receiving-side connector.

Furthermore, a connector housing device according to the present invention includes a receiving-side connector to which a connecting-side connector is connected from outside; a main frame that supports the receiving-side connector in such a manner that the receiving-side connector moves between a waiting position at which the connecting-side connector is connected to the receiving-side connector and a holding position at which the connecting-side connector is kept in a connected state; a connector biasing unit that applies a biasing force in an ejecting direction from the holding position to the waiting position to the receiving-side connector; and a pressing-force applying unit that applies, when the receiving-side connector is not moved by the biasing force after a hold on the receiving-side connector is released, a pressing force for ejecting the receiving-side connector to the receiving-side connector.

Moreover, an electronic device according to the present invention includes the connector housing device, and is electrically connected with a connecting electronic device including the connecting-side connector by connecting the receiving-side connector and the connecting-side connector.

The connector housing device and the electronic device according to the present invention achieve an effect of secure eject of a connecting electronic device that is housed.

EXPLANATIONS OF LETTERS OR NUMERALS

Figure 1:
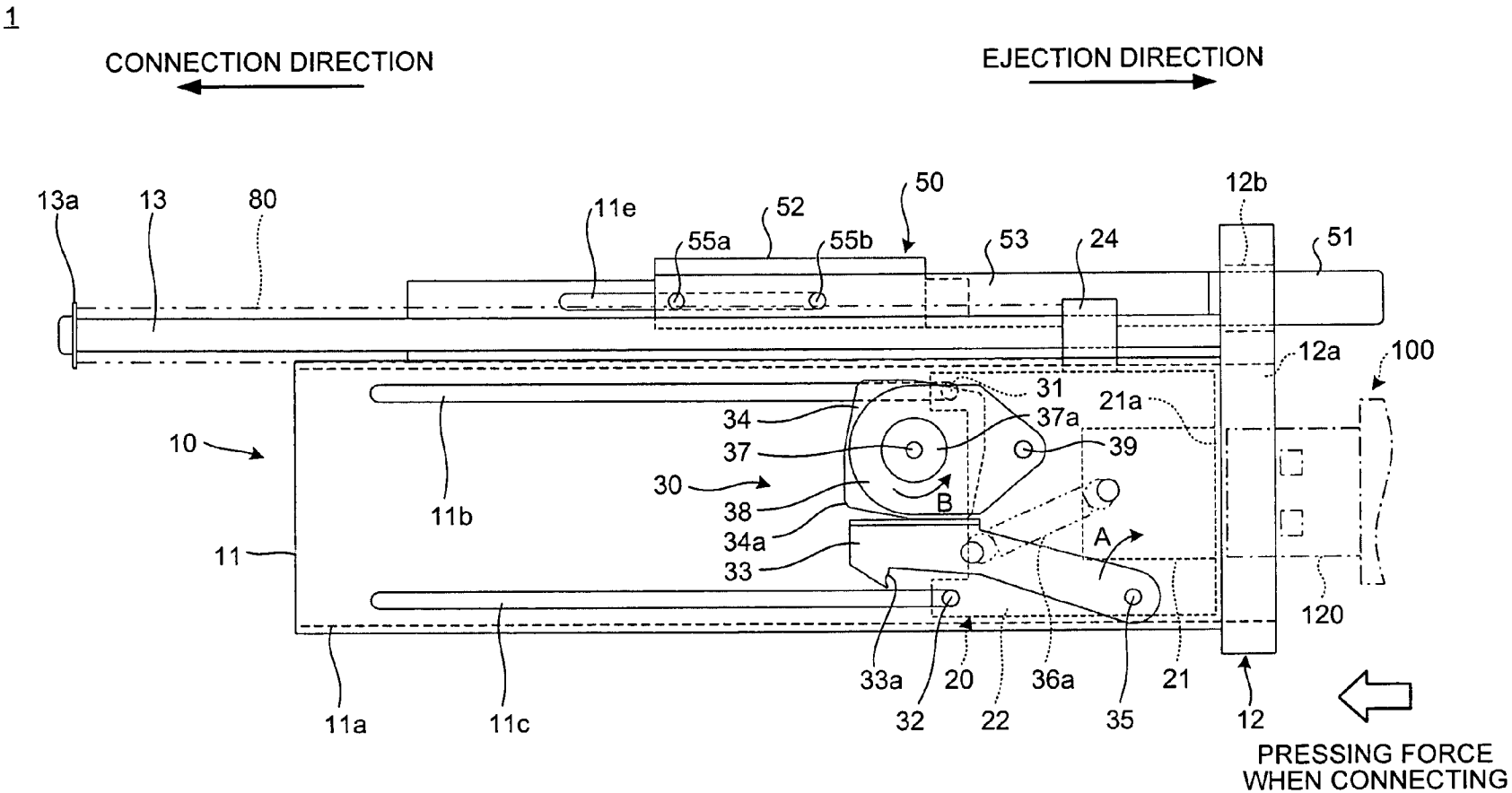
FIG. 1 is a diagram (left lateral view) of a configuration example of a connector housing device according to an embodiment.

1 Connector housing device
10 Main frame
11 Connector storing unit
11*a* Cavity
11*b* First slit
11*c* Second slit
11*d* Third slit
11*e* Fourth slit
11*f* Fifth slit
12 Surface
12*a* Opening
12*b* Button hole
13 Shaft
13*a* Flange portion
20 Receiving-side connector
21 Receiving-side connector main body
21*a* Connecting surface
22 Connector case
23 Rack component
24 Guide component
30 Control unit
31 Cam-driving pin
32 Control pin
33 Pin lock lever
33*a* Locking unit
34 Cam
34*a* Corner
34*b*, 34*c* Cam gear teeth
35 Lever rotating axis
36*a* Lever biasing unit
36*b* Cam biasing unit
37 Cam rotating axis
37*a* Flange portion
38 Cam rotation control component
38*a* Control gear teeth
39 Control component supporting axis
40 Holding unit
41 Holding rack
41*a* Holding gear teeth
42 Rack lock arm
43 Arm rotating axis
44 Holding protrusion
45 Hold releasing pin
46 Arm biasing unit
50 Hold releasing unit
51 Eject button (hold releasing button)
52 Releasing and removing component
52*a* Step
53 Attachment arm
54 Hold releasing arm
55*a*, 55*b* Slide pin
56 Arm rotating axis
57*a*, 57*b* Rotation controlling axis
58 Arm biasing unit
59 Button biasing unit
60 Pressing-force applying unit
61 Button-side ejecting rack
61*a* Button-side removing gear teeth
62 Connector-side ejecting rack
62*a* Connector-side removing gear teeth
70 Gear unit
71 Drive gear
72 Eject gear
73 Transmission gear
80 Connector biasing unit
100 Connecting electronic device
110 Connecting electronic device main body
120 Connecting-side connector
130 Memory medium
200 Non-standard connecting electronic device
210 Connecting electronic main body
210*a* Outer periphery
220 Connecting-side connector

BEST MODE(S) FOR CARRYING OUT THE INVENTION

Exemplary embodiments of the present invention are described in detail below with reference to the accompanying drawings. The present invention is not limited to the embodiments described below. Constituent elements according to the embodiments described below include elements easily conceived by a person skilled in the art or elements that are effectively the same. In the descriptions below, instances in which a USB-standard connector is used as a connector is explained. However, the present invention is not limited thereto. Connectors using other standards, such as IEEE1394 standard or SCSI standard, can be used.

EMBODIMENTS

Figure 3:
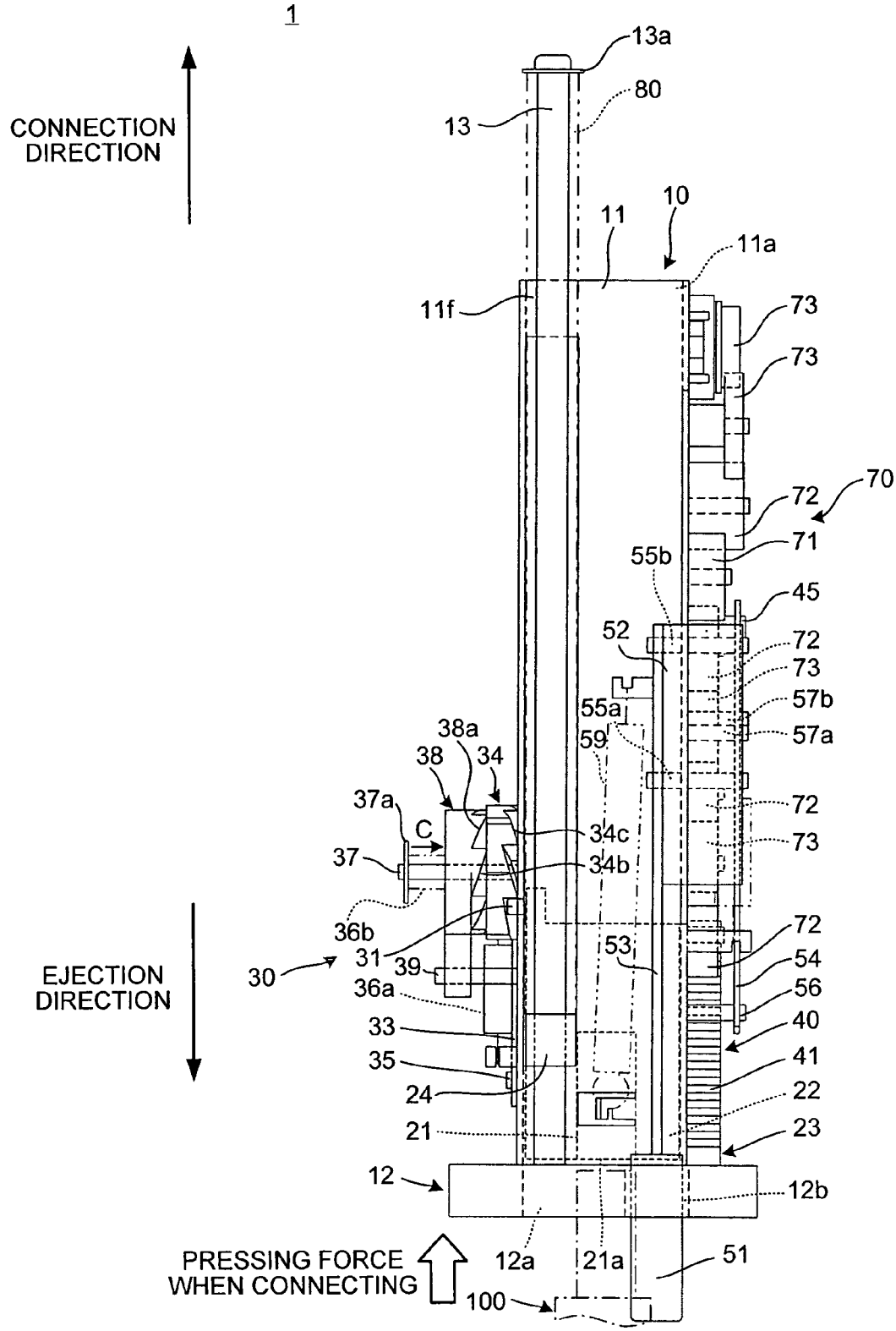
FIG. 3 is a diagram (planar view) of the configuration example of the connector housing device according to the embodiment.
Figure 4:
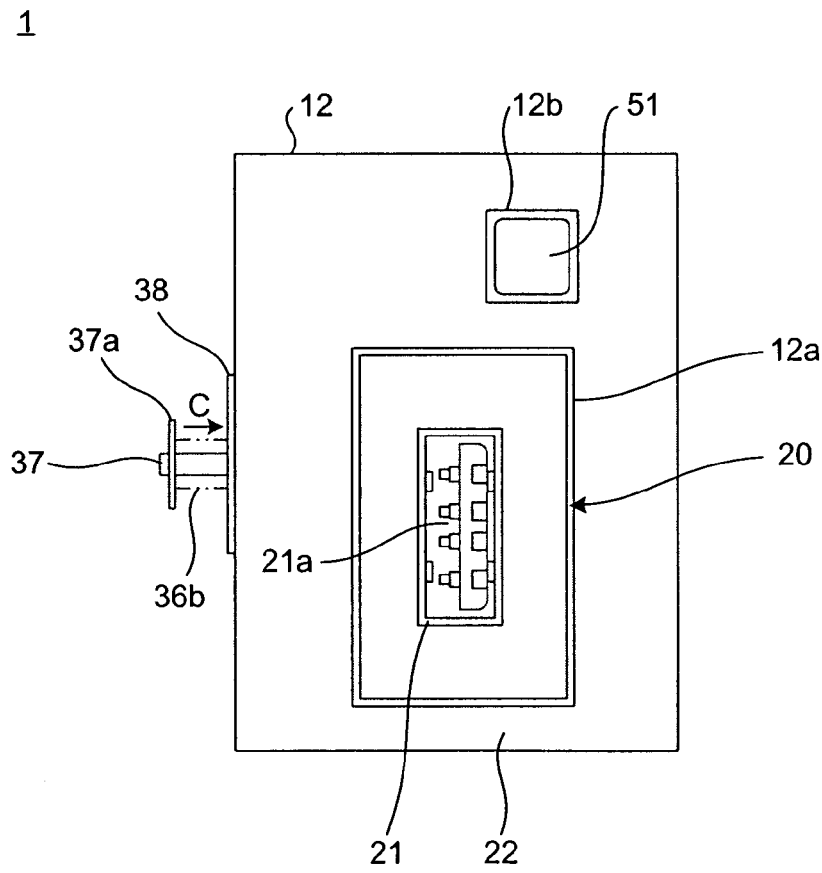
FIG. 4 is a diagram (front elevational view) of the configuration example of the connector housing device according to the embodiment.
Figure 5:
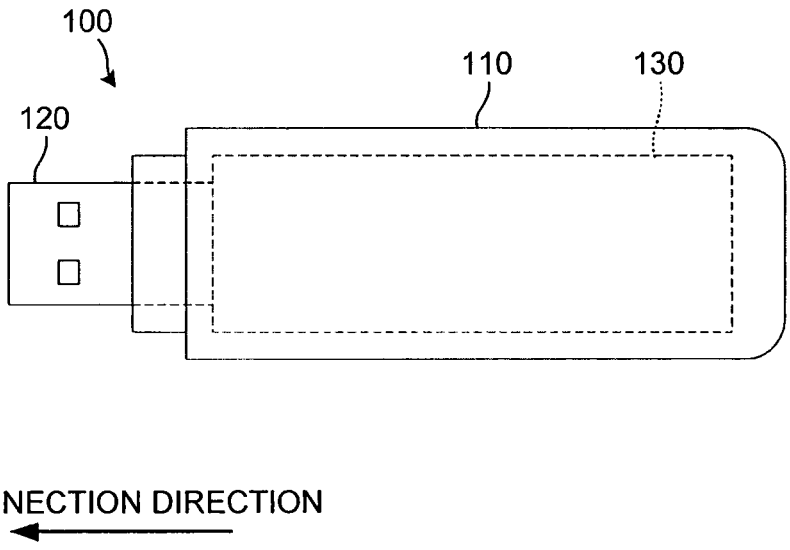
FIG. 5 is a diagram of a configuration example of a connecting electronic device.

FIG. 1 to FIG. 4 are diagrams of a configuration example of a connector housing device according to an embodiment. FIG. 5 is a diagram of a configuration example of a connecting electronic device. As shown in FIG. 1 to FIG. 4, a connector housing device 1 according to the embodiment houses a connecting-side connector 102 of a popular connecting electronic device 100, such as that shown in FIG. 5. The connector housing device 1 includes a main frame 10, a receiving-side connector 20, a control unit 30, a holding unit 40, a hold releasing unit 50, a pressing-force applying unit 60 and a connector biasing unit 80. The pressing-force applying unit 60 includes a gear unit 70. The connector housing device 1 is provided in an electronic device, such as a vehicle-mounted electronic device or a portable electronic device (not shown). The vehicle-mounted electronic device is, for example, a car audio device or a car navigation device. The portable electronic device is, for example, a laptop computer or a PDA that can be carried by a user.

The receiving-side connector 20 is disposed within the main frame 10. The main frame 10 holds the receiving-side connector 20 to allow the receiving-side connector 20 to move in a connection direction. The connection direction is a direction in which a connecting-side connector 120 described hereafter, is connected to the receiving-side connector 20 (an internal direction of the main frame 10). Therefore, the main frame 10 holds the receiving-side connector 20, to which the connecting-side connector 120 is connected, to allow the receiving-side connector 20 to move in the internal direction. The main frame 10 includes a connector storing unit 11, a surface 12, and a shaft 13.

The connector storing unit 11 is formed by a metal plate having a roughly cylindrical shape. The receiving-side connector 20 is disposed in a cavity 11*a* within the connector storing unit 11. The control unit 30, the holding unit 40, the hold releasing unit 50, and the pressing-force applying unit 60 are formed on opposing surfaces of the connector storing unit 11. The control unit 30 is provided on one surface (hereinafter, referred to as a "left side surface"). A first slit 11*b* and a second slit 11*c* are formed on the left side surface so as to extend in the connection direction (see FIG. 1). The holding unit 40, the hold releasing unit 50, and the pressing-force applying unit 60 of the connector storing unit 11 are provided on another surface (hereinafter, referred to as a "right side surface"). A third slit 11*d* and a fourth slit 11*e* are formed on the right side surface so as to extend in the connection direction (see FIG. 2). A fifth slit 11*f* is formed on one side surface (hereinafter, referred to as a "top side surface") of the connector storing unit 11, among side surfaces excluding the left side surface and the right side surface, so as to extend in the connection direction (see FIG. 3). Both ends of the connector storing unit 11 on a longitudinal-direction side are open.

The surface 12 is formed separately from or integrally with an externally-exposed surface of the electronic device (not shown). The surface 12 covers an end of the connector storing unit 11 that is on a eject direction side (an external direction of the main frame 10). The eject direction is a direction opposite of the connection direction. An opening 12*a* is formed on the surface 12. The connecting-side connector 120 and a connecting electronic device main body 110 of the connecting electronic device 100 can be inserted into the opening 12*a* in the connection direction. A button hole 12*b* that projects a eject button, described hereafter, in the eject direction is also formed on the surface 12.

An end of the shaft 13 on the eject direction side is fixed to the surface 12. The shaft 13 extends in the connection direction. A flange portion 13*a* is fixed to an end of the shaft 13 in the connection direction.

The connecting-side connector 120 provided in the connecting electronic device 100 is connected to the receiving-side connector 20. The connecting electronic device 100 is a connection-subject of the electronic device including the connector housing device 1. The receiving-side connector 20 is held by the main frame 10 so as to be movable in the connection direction. The receiving-side connector 20 includes a receiving-side connector main body 21, a connector case 22, a rack component 23, and a guide component 24. The receiving-side connector main body 21 is a female connector having a USB-standard shape. The receiving-side connector main body 21 is fixed to the connector case 22 so that a connecting surface 21*a* of the receiving-side connector main body 21 is exposed on a surface of the connector case 22 on the eject direction side. Therefore, the receiving-side connector main body 21 is positioned within a plane of projection of the opening 12*a*, when the opening 12*a* of the surface 12 is viewed in the connection direction, as shown in FIG. 4.

The receiving-side connector main body 21 is fixed to an interior of the connector case 22. A cam-driving pin 31 and a control pin 32 are formed on a side surface of the connector case 22 opposing the left side surface of the connector storing unit 11. The cam-driving pin 31 and the control pin 32 are respectively inserted into the first slit 11*b* and the second slit 11*c*. A tip of the cam-driving pin 31 and a tip of the control pin 32 protrude from the left side surface of the connector storing unit 11. The cam-driving pin 31 and the control pin 32 can move in the connection direction in which the first slit 11*b* and the second slit 11*c* are extended.

The rack component 23 is formed on a side surface of the connector case 22 opposing the right side surface of the connector storing unit 11. The rack component 23 is inserted into the third slit 11*d* and protrudes from the right side surface of the connector storing unit 11. The rack component 23 can move in the connection direction in which the third slit 11*d* is extended. A connector-side ejecting rack 62 of the pressing-force applying unit 60 is formed on one side surface of the rack component 23 (the top side surface in FIG. 2), among side surfaces opposing in a direction perpendicular to a longitudinal direction of the rack component 23. A holding rack 41 is formed on another side surface (a bottom side surface in FIG. 2).

The guide component 24 is formed on a surface of the connector case 22 opposing the top side surface of the connector storing unit 11. The guide component 24 is supported by the shaft 13 in a state in which the guide component 24 is inserted into the fifth slit 11*f*. Therefore, the guide component 24 can move in the connection direction. The connection direction is the direction in which the fifth slit 11*f* is extended and an axial direction of the shaft 13. In other words, the connector case 22 is supported by the connector storing unit 11 and the shaft 13 so as to be movable in the connection direction. Therefore, the main frame 10 supports the receiving-side connector 20 so as to allow the receiving-side connector 20 to move in the connection direction.

The connector biasing unit 80 is attached between the guide component 24 and the flange portion 13*a* of the shaft 13. The connector biasing unit 80 is, for example, a spring. The connector biasing unit 80 applies a biasing force in the external direction of the main frame 10 or, in other words, a biasing force for eject in the eject direction, to the receiving-side connector 20. Therefore, when the pressing force in the connection direction is not applied to the receiving-side connector 20, the receiving-side connector 20 is positioned in a waiting position by the biasing force for eject. The waiting position is near the end of the connector storing unit 11 in the main frame 10 on the eject direction side.

The control unit 30 controls movement of the receiving-side connector 20 in the connection direction to the main frame 10. The control unit 30 includes the cam-driving pin 31 and the control pin 32 provided in the receiving-side connector 20, a pin lock lever 33, and a cam 34.

The pin lock lever 33 is supported by the connector storing unit 11 of the main frame 10 so as to be rotatable by a lever rotating axis 35. A locking unit 33*a* for locking the control pin 32 is formed on the pin lock lever 33 on a side opposite of a lever rotation axis side. A lever biasing unit 36*a* is attached between the pin lock lever 33 and the connector storing unit 11. The lever biasing unit 36*a* is, for example, a spring. The lever biasing unit 36*a* applies a biasing force for control releasing in an arrow A direction in FIG. 1 or, in other words, in a control release direction. The pin lock lever 33 is in constant contact with the cam 34 because of the biasing force for control release.

The cam 34 is roughly square-shaped. Four corners 34*a* are formed in the cam 34. The cam 34 is supported by the connector storing unit 11 of the main frame 10 so as to be rotatable by a cam rotating axis 37. A flange portion 37*a* is formed on a tip of the cam rotating axis 37.

A plurality of cam gear teeth 34*b* and 34*c* are respectively formed on side surfaces of the cam 34. The cam gear teeth 34*b* and 34*c* are in succession in a circumferential direction. The side surfaces are opposing in an axial direction of the cam rotating axis 37. The cam gear teeth 34*b* formed on one side surface (the left side surface in FIG. 1) mesh with control gear teeth 38*a* formed on a side surface of a cam rotation control component 38 opposing the cam 34 (the right side surface in FIG. 1). In a state in which the cam gear teeth 34*b* and the control gear teeth 38 are meshing, the receiving-side connector 20 moves in the connection direction from the waiting position. The cam-driving pin 32 also moves in the connection direction. Then, the cam-driving pin 31 comes into contact with the cam 34. Rotation of the cam 34 is permitted only in a direction in which the cam 34 rotates or, in other words, in an arrow B direction in FIG. 1. As a result of the receiving-side connector 20 starting to move in the connection direction from the waiting position and the cam-driving pin 32 also moving in the connection direction, the cam gear teeth 34*b* formed on another side surface (the right side surface in FIG. 3) comes into contact with the cam-driving pin. As a result of the cam-driving pin further moving in the connection direction, the cam 34 is rotated in the arrow B direction in FIG. 1 or, in other words, a rotatable direction.

The cam rotation control component 38 is disposed between the flange portion 37*a* of the cam rotation axis 37 and the cam 34. The cam rotation control component 38 is supported by a control component supporting axis 39 and the cam rotating axis 37 so as to be movable in the axial direction of the cam rotating axis 37. A cam biasing unit 36*b* is attached between the cam rotation control component 38 and the flange portion 37*a*. The cam biasing unit 36*b* is, for example, a spring. The cam biasing unit 36*b* applies a biasing force for rotation control to the cam rotation control component 38. The biasing force for rotation control is applied in an arrow C direction in FIG. 1 or, in other words, a cam rotation control direction that is one direction of the axial direction of the cam rotating axis 37. The control gear teeth 38*a* of the cam rotation control component 38 is in constant contact with the cam gear teeth 34*b* of the cam 34 because of the bias force for rotation control.

When the receiving-side connector 20 is moved in the connection direction to the main frame 10, the holding unit 40 holds the receiving-side connector 20 in an arbitrary position (holding position) to which the receiving-side connector 20 has moved. In other words, the holding unit 40 holds the receiving-side connector 20 moved into the main frame 10 to the main frame 10. The control unit 40 includes the holding rack 41 provided in the receiving-side connector 20 and a rack lock arm 42. The holding rack 41 includes a plurality of holding gear teeth 41*a* formed in succession in the connection direction to the rack component 23.

The rack lock arm 42 is supported by the connector storing unit 11 of the main frame 10 so as to be rotatable by an arm rotating axis 43. A holding protrusion 44 and a hold releasing pin 45 are formed on the rack lock arm 42, on a side opposite of the arm rotating axis side or, in other words, on the connection direction side. As a result of the receiving-side connector 20 moving in the connection direction from the waiting position, the holding protrusion 44 meshes with the holding gear teeth 41*a* in the holding rack 41. In a state in which the holding protrusion 44 and the holding gear teeth 41*a* are meshing, the holding protrusion 44 locks the holding gear teeth 41*a* and controls the movement of the holding rack 41 in the eject direction, only when the receiving-side connector 20 attempts to move in the eject direction. In other words, the rack lock arm 42 controls the movement of the receiving-side connector 20 in the eject direction by coming into contact with the holding rack 41. An arm biasing unit 46 is attached between the rack lock arm 42 and the connector storing unit 11. The arm biasing unit 46 is, for example, a spring. The arm biasing unit 46 applies a biasing force for holding to the rack lock arm 42. The biasing force for holding is applied in an arrow D direction in FIG. 2 or, in other words, in a holding direction that is one direction among rotational directions of the rack lock arm 42. Therefore, the rack lock arm 42 is in constant contact with a hold releasing arm 54, described hereafter, because of the biasing force for holding.

The hold releasing unit 50 releases a hold placed by the holding unit 40. In addition, the hold releasing unit 50 moves the receiving-side connector 20 in the eject direction by the biasing force for eject. The biasing force for eject is applied in the eject direction by the connector biasing unit 80. In other words, the hold releasing unit 50 releases the hold placed by the holding unit 40. As a result, the hold releasing unit 50 returns the receiving-side connector 20 from the holding position to the waiting position by the biasing force for eject applied to the receiving-side connector 20. The biasing force for eject is applied in the eject direction by the connector biasing unit 80. The hold releasing unit 50 includes a eject button 51 that is a hold releasing button, a releasing and removing component 52, an attachment arm 53, and the hold releasing arm 54.

The eject button 51 that is the hold releasing button is attached to an end of the attachment arm 53 on a eject direction side. The releasing and removing component 52 is connected to an end of the attachment arm 53 on a connection direction side. The releasing and removing component 52 and the attachment arm 53 sandwich an area of the connector storing unit 11 in which the fourth slit 11*e* is formed. A step 52*a* is formed on a surface of the releasing and removing component 52 on the hold releasing arm side. In the step 52*a*, the eject direction side protrudes more to the hold releasing arm side than the connection direction side. A button-side ejecting rack 61 of the pressing-force applying unit 60 is formed on the connection direction side of the surface.

A slide pin 55*a* and a slide pin 55*b* are fixed between the releasing and removing component 52 and the attachment arm 53, as shown in FIG. 3. The slide pin 55*a* and the slide pin 55*b* are inserted into the fourth slit 11*e*. Therefore, the hold releasing button 52 is supported by the slide pin 55*a* and the slide pin 55*b* so as to be movable in the connection direction in which the fourth slit 11*e* is extended. In other words, the eject button 51 that is attached to the hold releasing button 52, via the attachment arm 53, is supported to be movable in the connection direction to the main frame 10.

Figure 2:
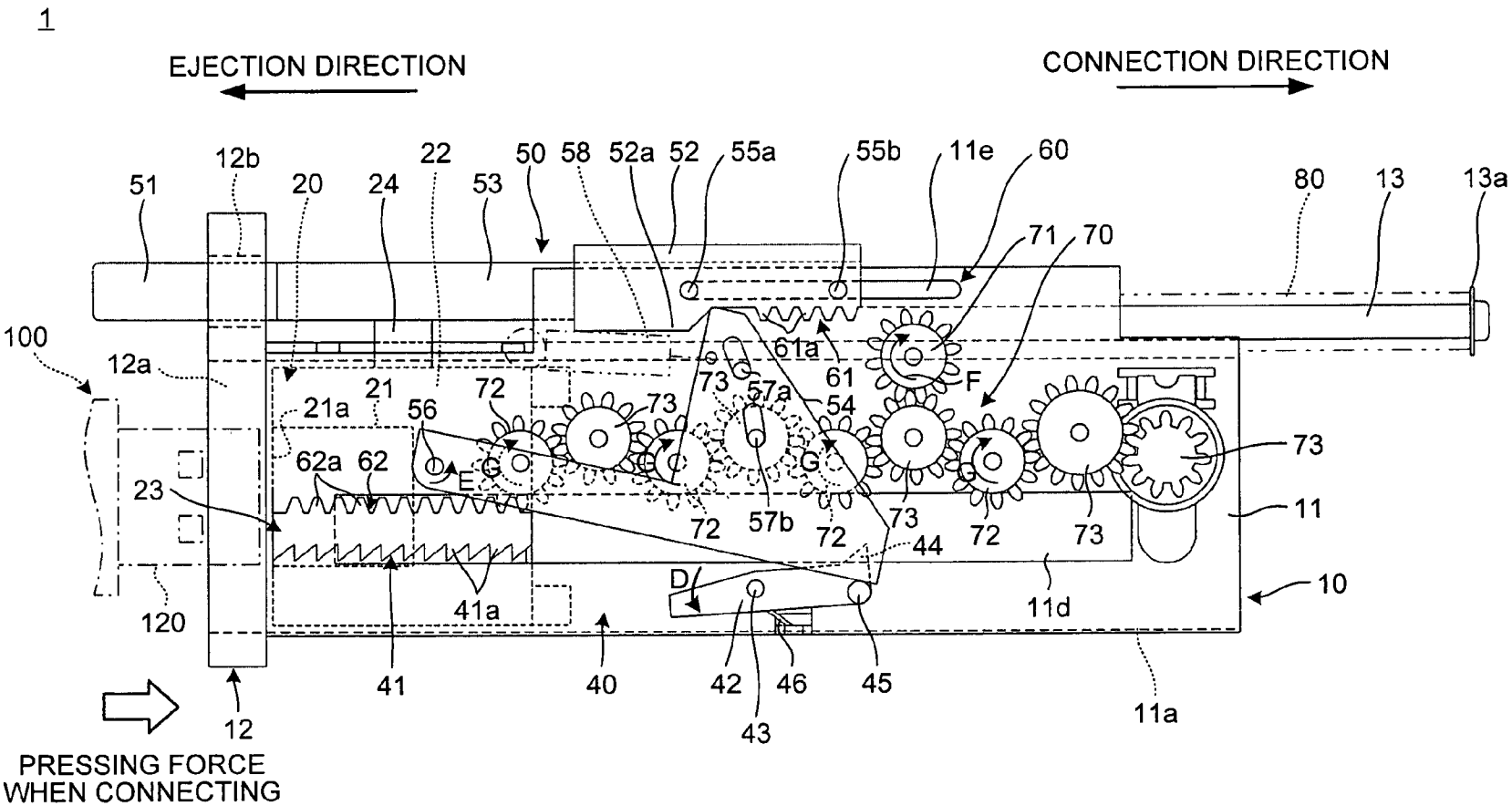
FIG. 2 is a diagram (right lateral view) of the configuration example of the connector housing device according to the embodiment.

A button biasing unit 59 is attached between the releasing and removing component 52 and the attachment arm 53, as shown in FIG. 3. The button biasing unit 59 is, for example, a spring. The button biasing unit 59 applies a return biasing force to the releasing and removing component 52 in the eject direction. Therefore, when the pressing force in the connection direction is not applied to the eject button 51, the eject button 51 is positioned at a normal position by the return biasing force, by the button hole 12*b* on the surface 12 of the main frame 10. In the normal position, the eject button 51 protrudes toward the eject direction side, as shown in FIG. 2.

The hold releasing arm 54 is held by the connector storing unit 11 of the main frame 10 so as to be rotatable by an arm rotating axis 56. Reference numerals 57*a* and 57*b* are rotation controlling axes controlling the rotation of the hold releasing arm 54. An arm biasing unit 58 is attached between the hold releasing arm 54 and the connector storing unit 11. The arm biasing unit 58 is, for example, a spring. The arm biasing unit 58 applies a biasing force for hold releasing to the hold releasing arm 54. The biasing force for hold releasing is applied in an arrow E direction in FIG. 2 or, in other words, in the hold releasing direction. The hold releasing arm 54 is in constant contact with a surface of the releasing and removing component 52 on the hold releasing arm side because of the biasing force for hold releasing.

The pressing-force applying unit 60 applies a pressing force for eject to the receiving-side connector 20 in the eject direction. In other words, when the hold placed by the holding unit 40 in the receiving-side connector 20 is released and the receiving-side connector 20 does not move because of the biasing force for eject from the connector biasing unit 80, the pressing-force applying unit 60 applies the pressing force for eject to the receiving-side connector 20 in the eject direction, thereby moving the receiving-side connector 20 in the eject direction. The pressing-force applying unit 60 includes the eject button 51 and a pressing-force converting unit. The pressing-force converting unit includes the button-side ejecting rack 61, the connector-side ejecting rack 62, and the gear unit 70. The button-side ejecting rack 61 is formed on the releasing and removing component 52. The connector-side ejecting rack 62 is provided on the receiving-side connector 20.

The eject button 51 is also the hold releasing button in the hold releasing unit 50. As described above, the eject button 51 is attached to the releasing and removing component 52 on which the button-side ejecting rack 61 is formed, via the attachment arm 53. In other words, the hold releasing button in the hold releasing unit 50 and the eject button 51 in the pressing-force applying unit 60 are formed by the same button. Therefore, through operation of one eject button 51, the hold placed on the receiving-side connector 20 by the holding unit 40 can be released. In addition, the pressing power for eject can be applied to the receiving-side connector 20 in the eject direction, via the pressing-force converting unit.

The button-side ejecting rack 61 included in the pressing-force converting unit includes a plurality of button-side removing gear teeth 61*a*. The button-side removing gear teeth 61*a* are formed in succession in the connection direction to the hold releasing component 52. The connector-side ejecting rack 62 included in the pressing-force converting unit includes a plurality of connector-side removing gear teeth 62*a*. The connector-side removing gear teeth 62*a* are formed in succession in the connection direction to the rack component 23.

The gear unit 70 included in the pressing-force converting unit includes a drive gear 71, a plurality of eject gears 72, and a plurality of transmission gears 73. The gears are respectively supported by the connector storing unit 11 of the main frame 11 so as to be rotatable by a gear rotating axis (not shown). The drive gear 71 meshes with one transmission gear 73, among the transmission gears 73 disposed in the connection direction. As a result of the releasing and removing component 52 moving in the connection direction from the normal position, the drive gear 71 meshes with the button-side removing gear teeth 61*a* of the button-side ejecting rack 61. The eject gears 72 are disposed in the connection direction and respectively mesh with adjacent transmission gears 73. The eject gears 72 are disposed so that a space between adjacent eject gears 72 is shorter than a length of the connector-side ejecting rack 62 in the connection direction. When the receiving-side connector 20 is positioned in the waiting position, a eject gear 72 closest to the eject direction side, among the eject gears 72, is disposed in a position meshing with the connector-side removing gear teeth 62*a* of the connector-side ejecting rack 62. In other words, even when the receiving-side connector 20 moves in the connection direction from the waiting position to the holding position, any one of the eject gears 72 constantly meshes with the connector-side removing gear teeth 62*a* of the connector-side ejecting rack 62.

When the releasing and removing component 52 moves in the connection direction as a result of a button pressing force in the connection direction being applied to the eject button 51, the button-side removing gear teeth 61*a* meshes with the drive gear 71. The button-side ejecting rack 61 rotates the drive gear 71 in an arrow F direction in FIG. 2 or, in other words, a eject side rotational direction. The rotational force of the drive gear 71 is transmitted to the eject gear 72, via a transmission gear 73. The eject gear 72 is rotated in an arrow G direction in FIG. 2 or, in other words, in the eject side rotational direction, in a same direction as the rotational direction of the drive gear 71. The rotational force of the eject gear 72 in the same direction as the rotational direction of the drive gear is transmitted to the connector-side removing gear teeth 62*a* and converted to a pressing force during abnormality. The pressing force during abnormality moves the receiving-side connector 20 including the connector-side ejecting rack 62 in the eject direction. In other words, the pressing-force converting unit converts the button pressing force applied to the eject button 51 in the connection direction to the pressing force for eject applied to the receiving-side connector in the eject direction.

The connecting electronic device 100 is a connecting electronic device having a popular shape, as shown in FIG. 5. The connecting electronic device 100 includes the connecting electronic device main body 110 and the connecting-side connector 120. An electronic storage component 130 including a memory medium and a communication device is housed within the connecting electronic device main body 110. The connecting-side connector 120 is a male connector having the USB-standard shape. The connecting-side connector 120 can be connected to the receiving-side connector main body 21 of the receiving-side connector 20.

Figure 6:
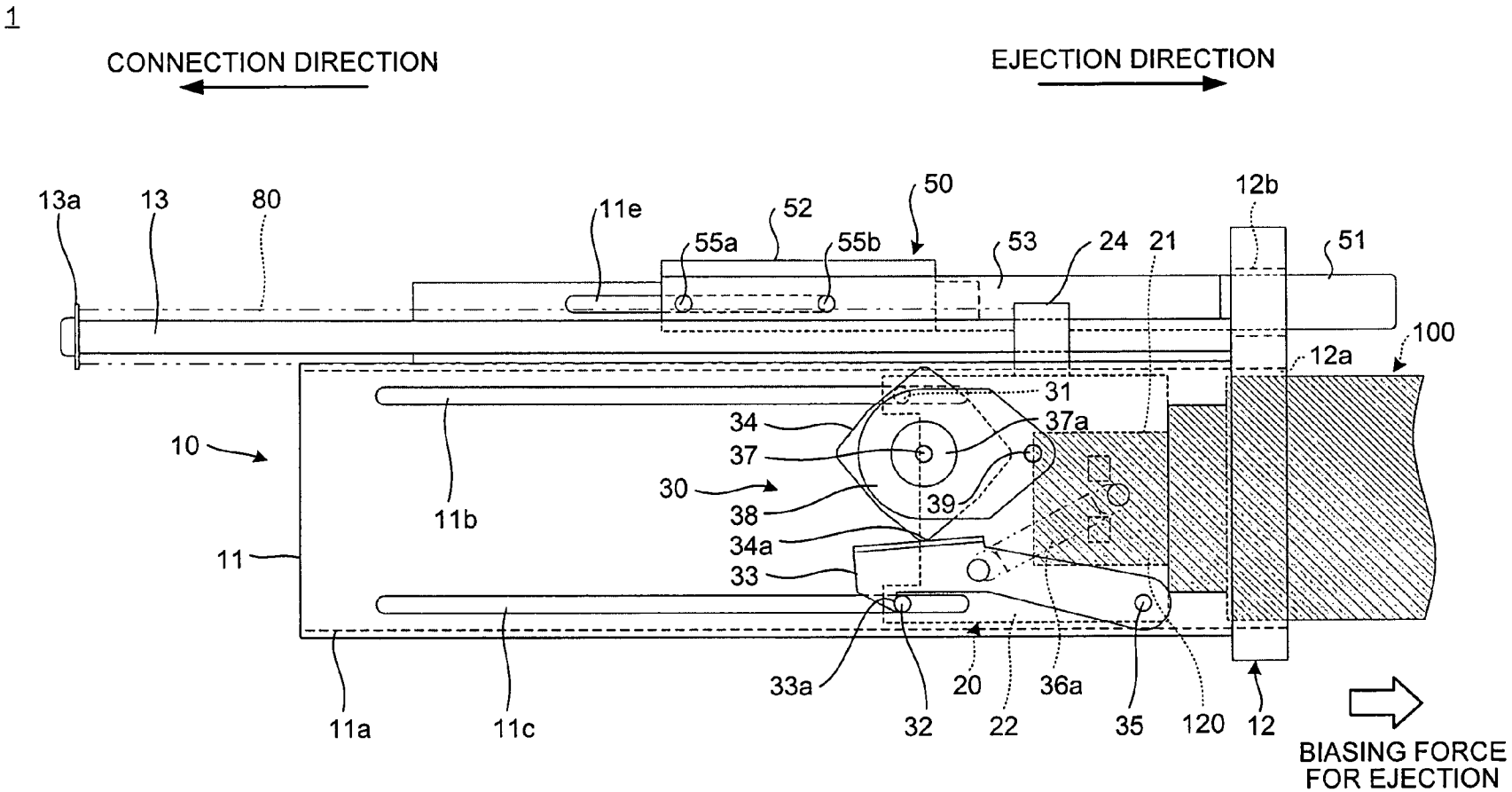
FIG. 6 is a diagram (left lateral view) of a connector housing device when connecting.
Figure 7:
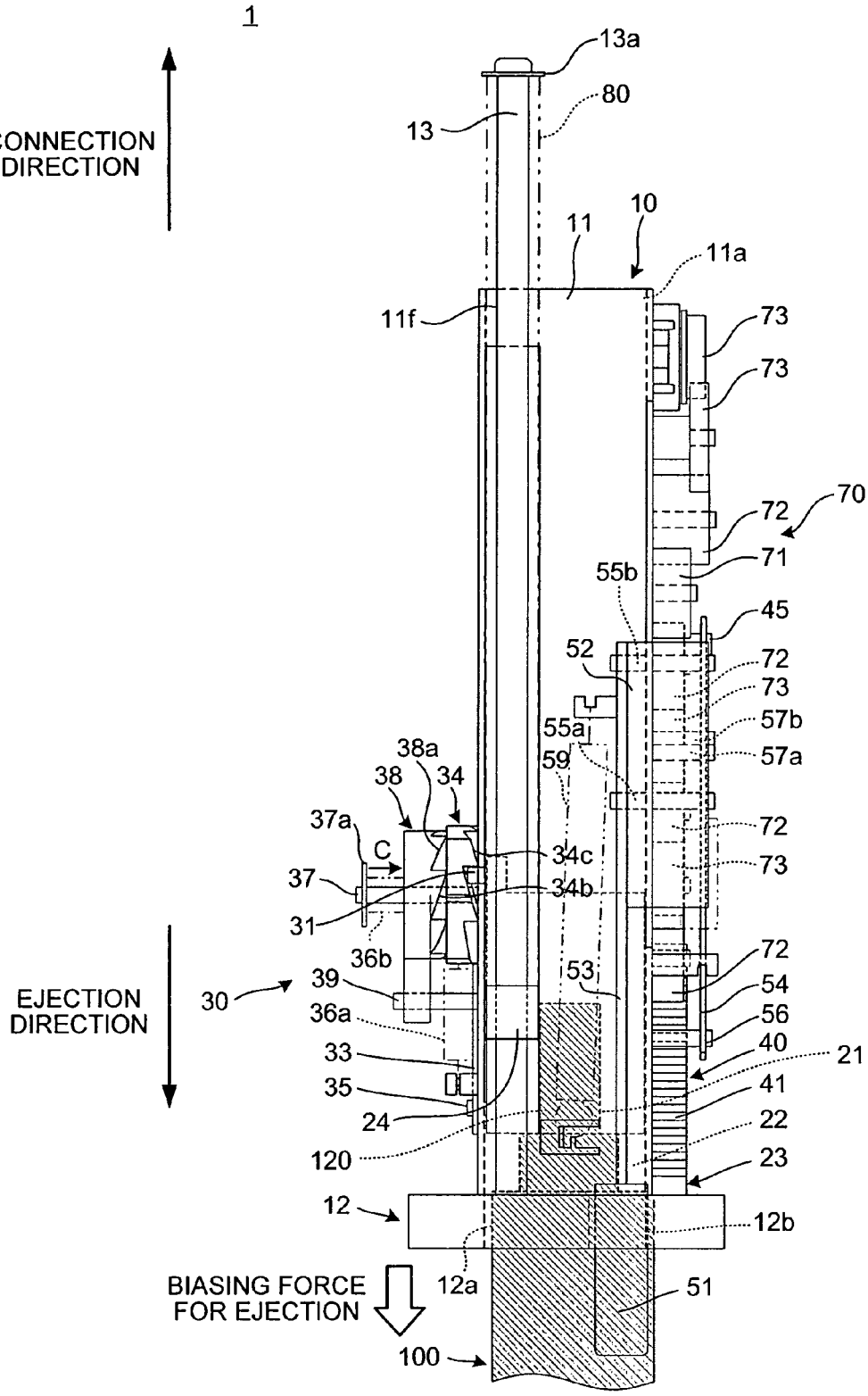
FIG. 7 is a diagram (planar view) of a connector housing device when connecting.
Figure 8:
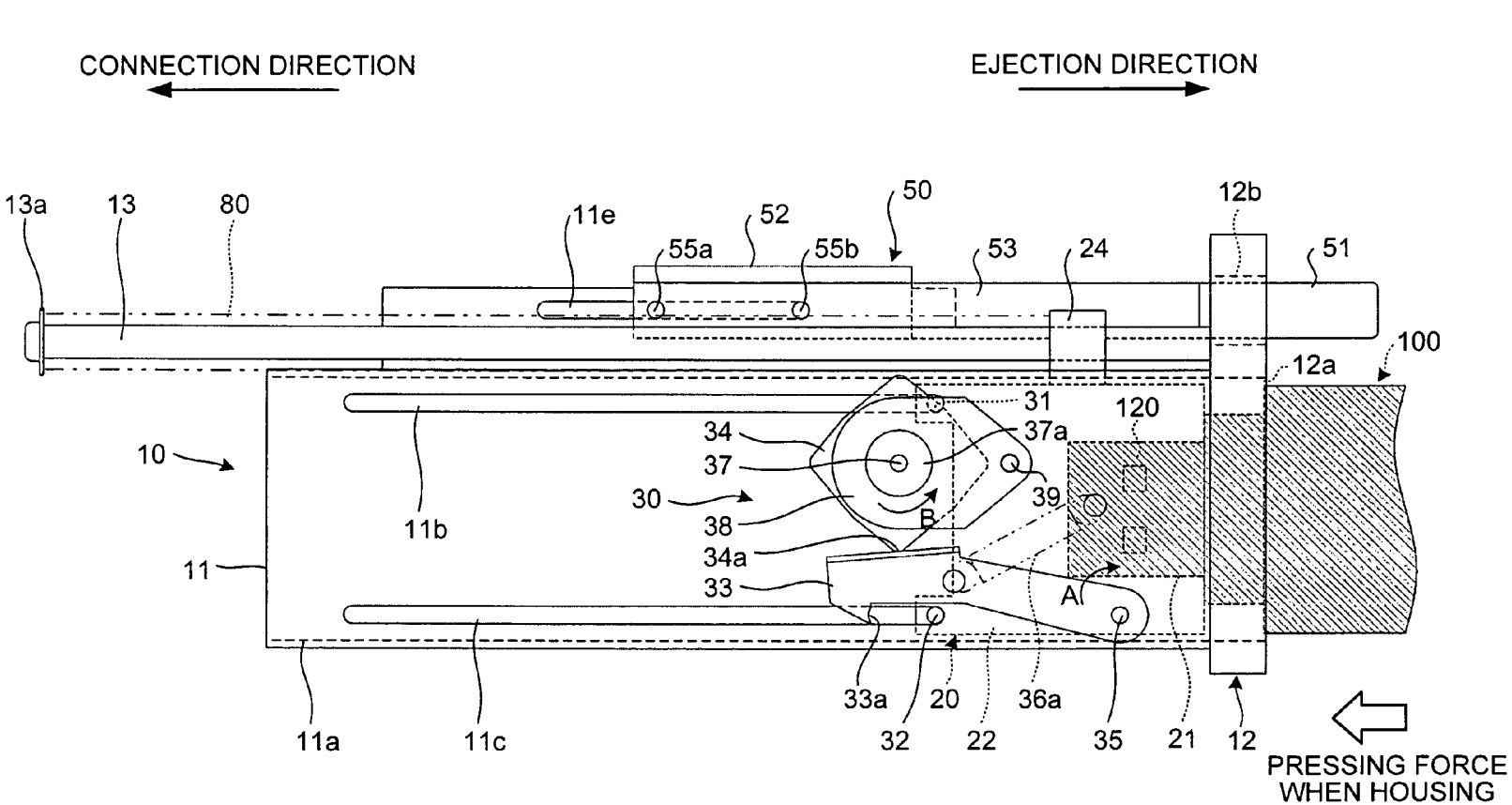
FIG. 8 is a diagram (left lateral view) of a connector housing device after connection.
Figure 9:
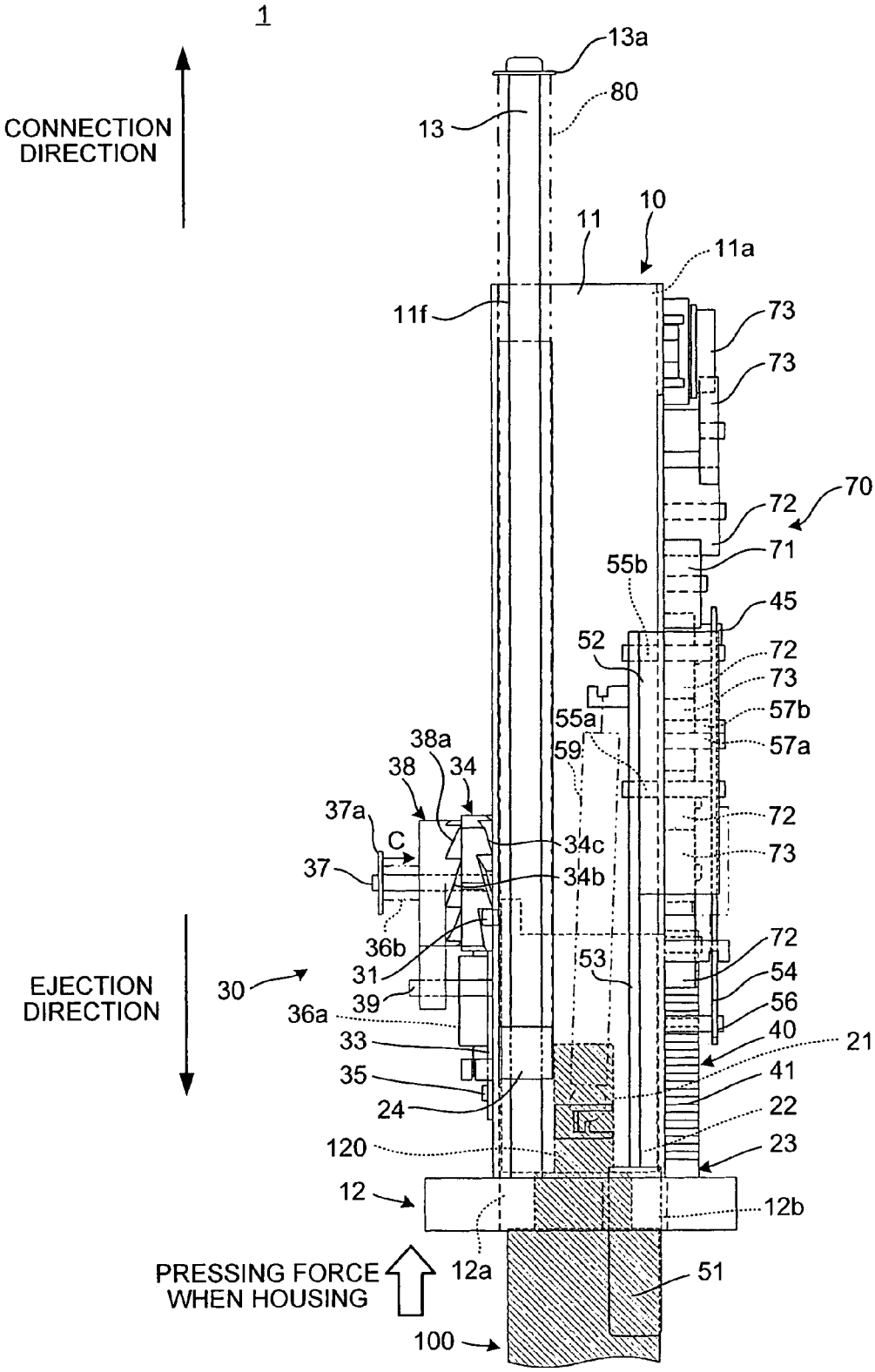
FIG. 9 is a diagram (planar view) of a connector housing device after connection.
Figure 10:
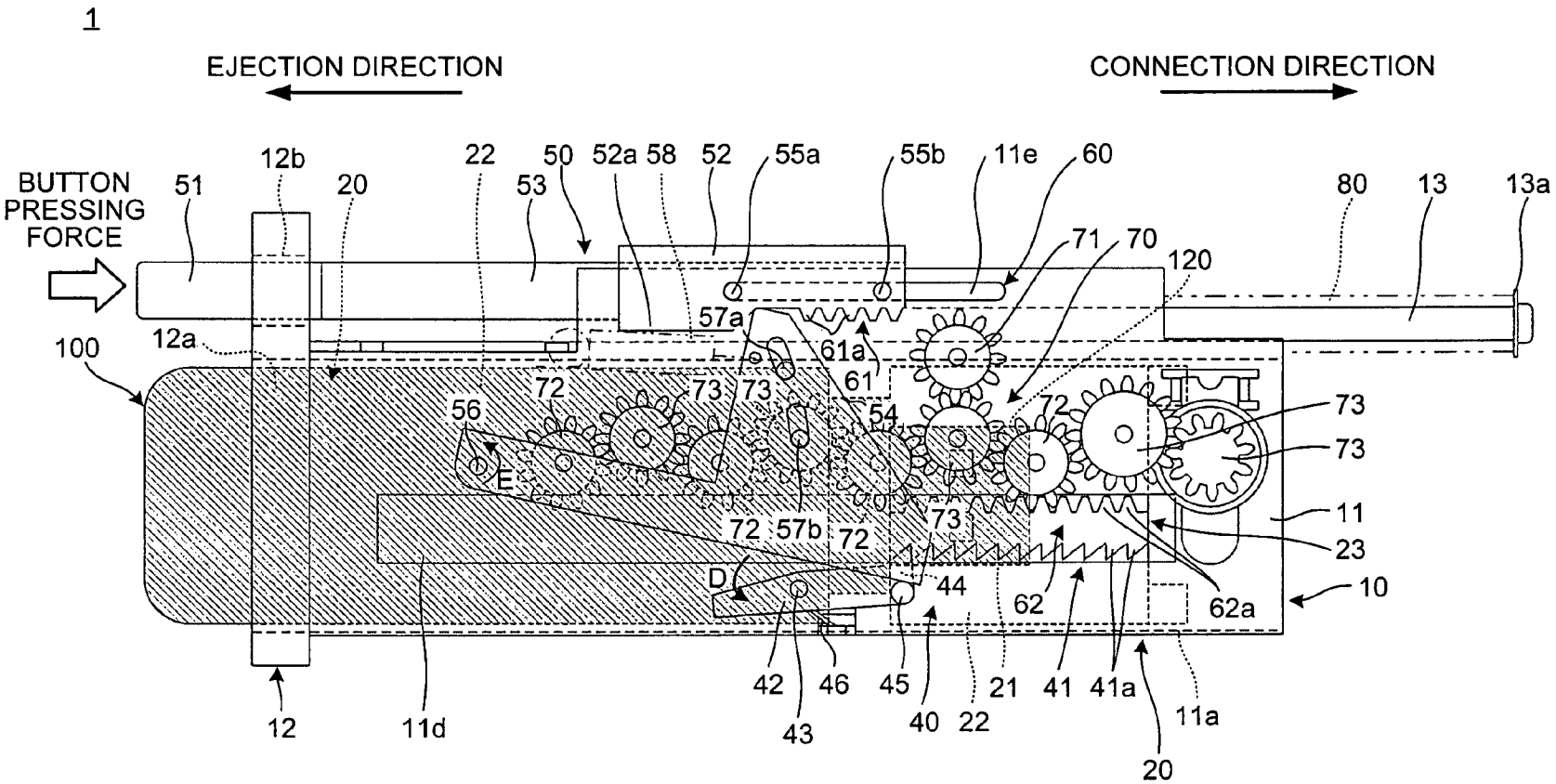
FIG. 10 is a diagram (right lateral view) of a connector housing device when storing.
Figure 11:
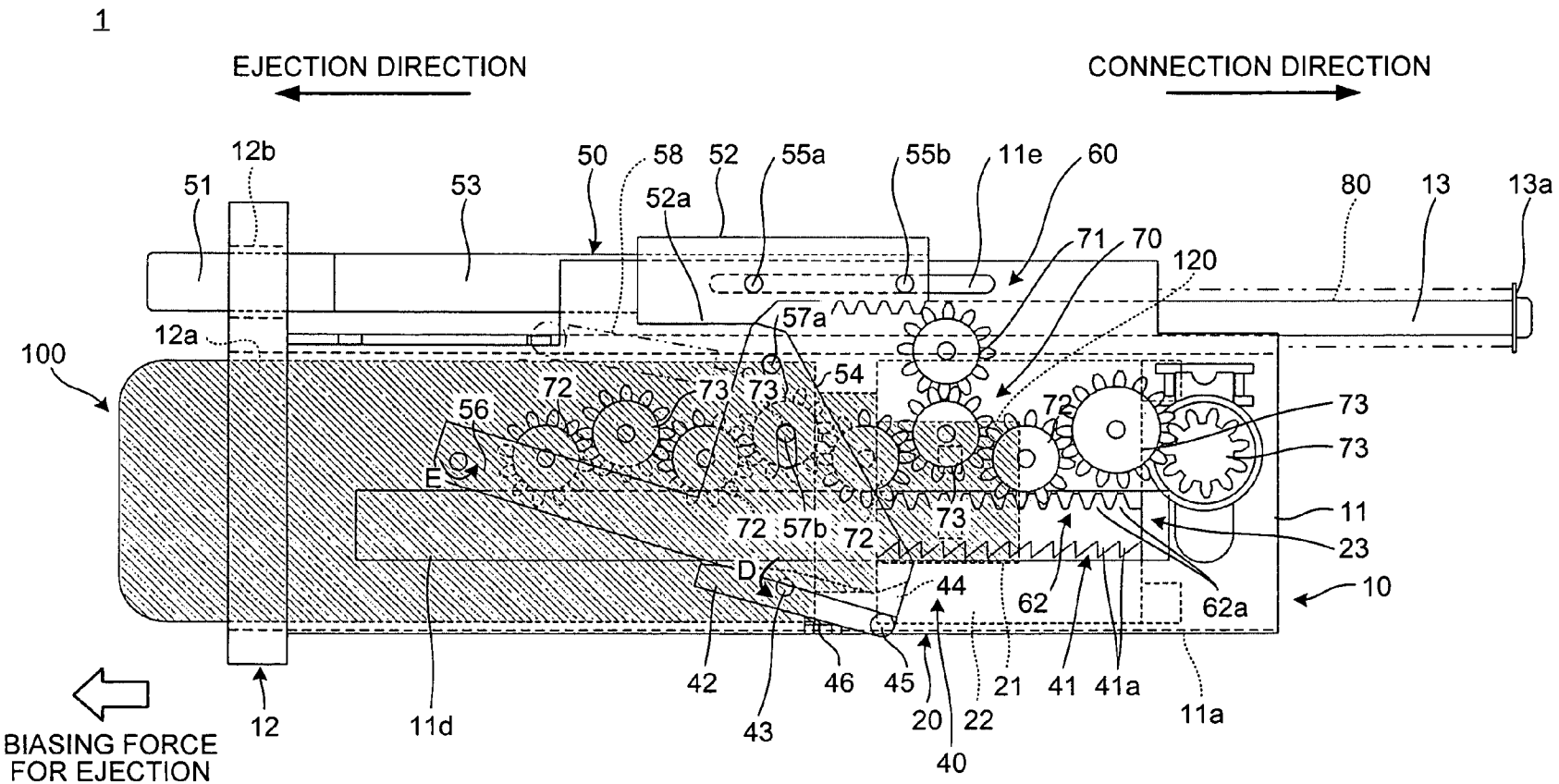
FIG. 11 is a diagram (right lateral view) of a connector housing device when removing.
Figure 12:
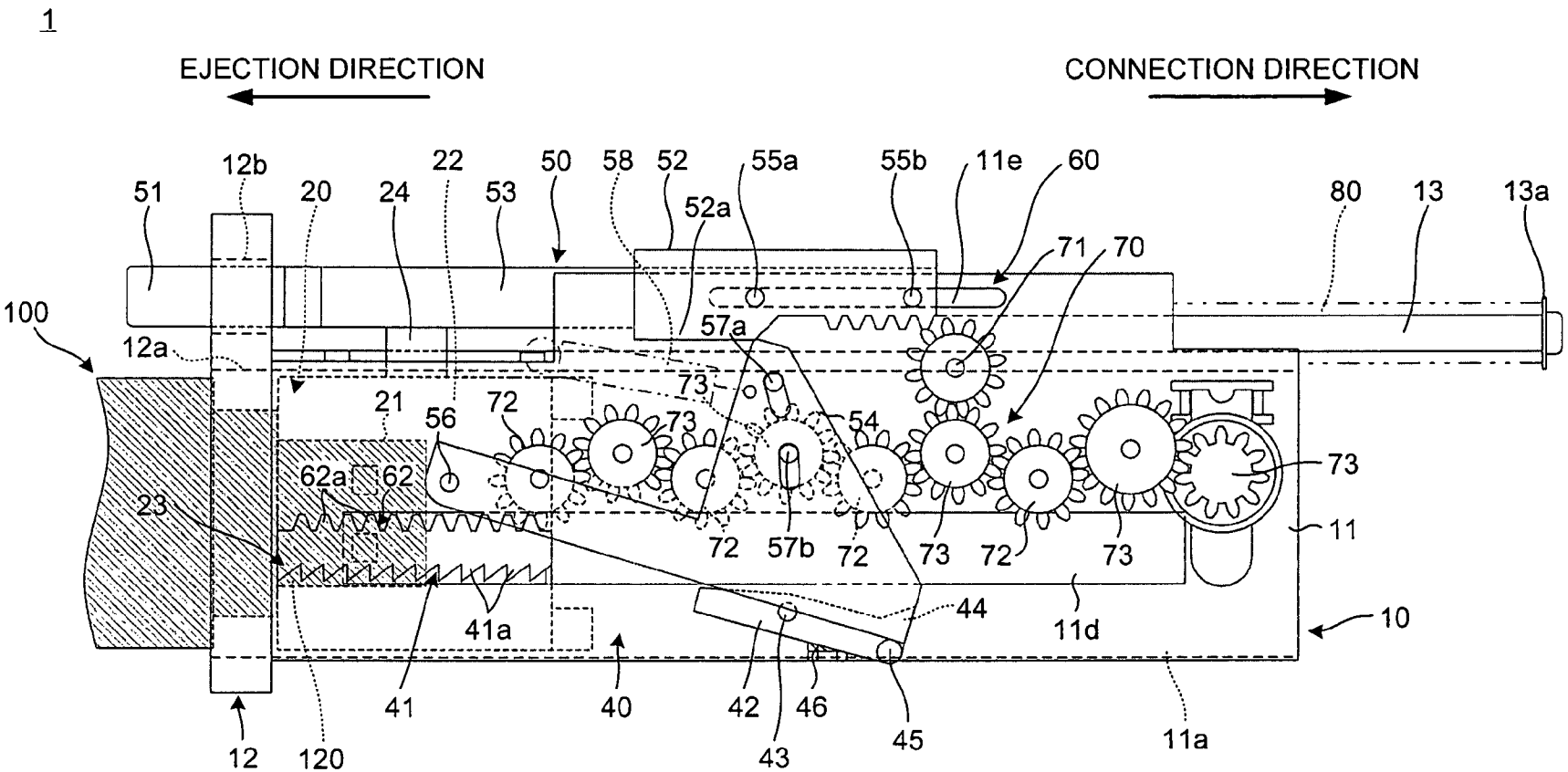
FIG. 12 is a diagram (right lateral view) of a connector housing device after eject.
Figure 13:
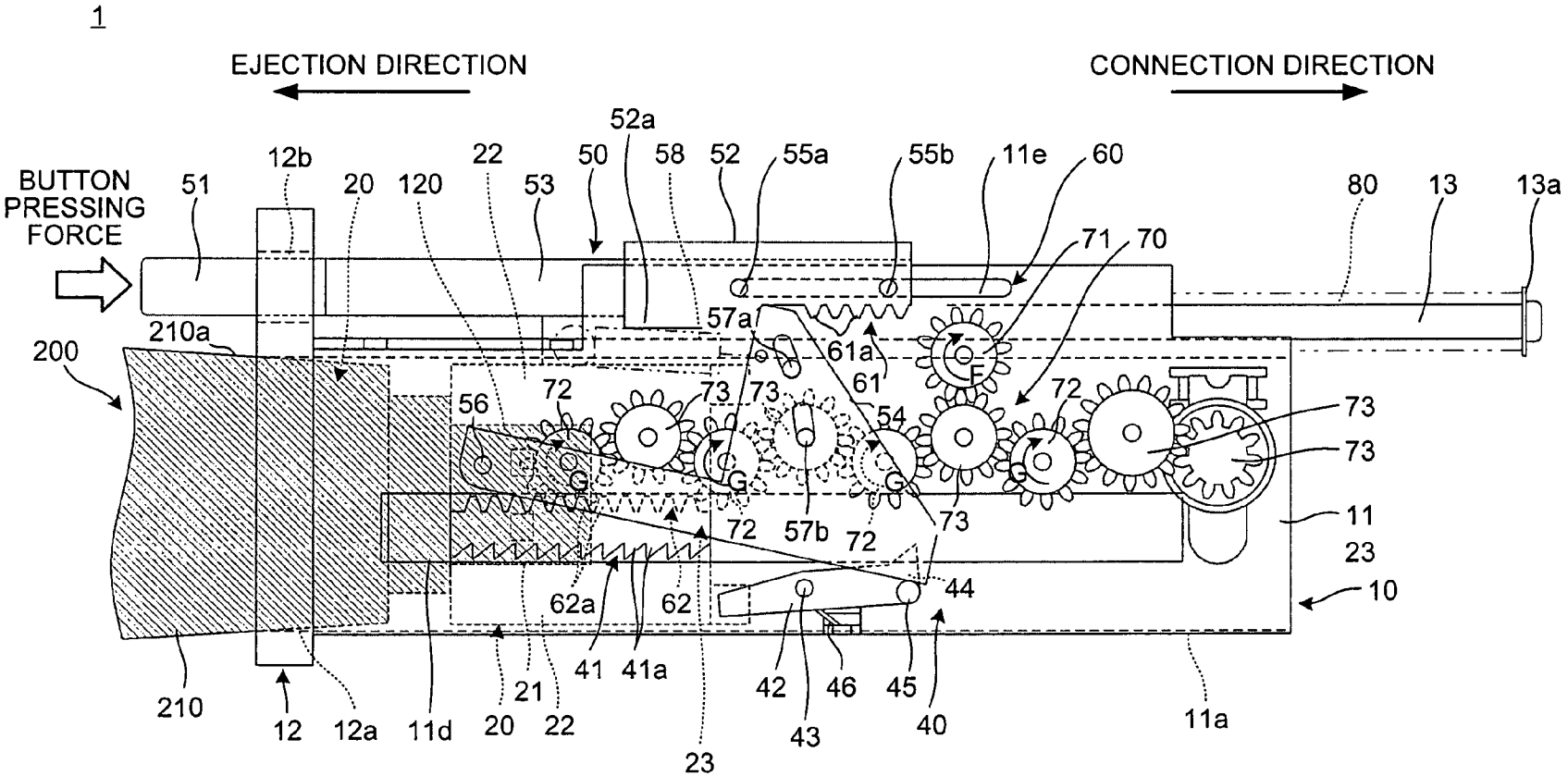
FIG. 13 is a diagram (right lateral view) of a connector housing device during an abnormal storage.
Figure 14:
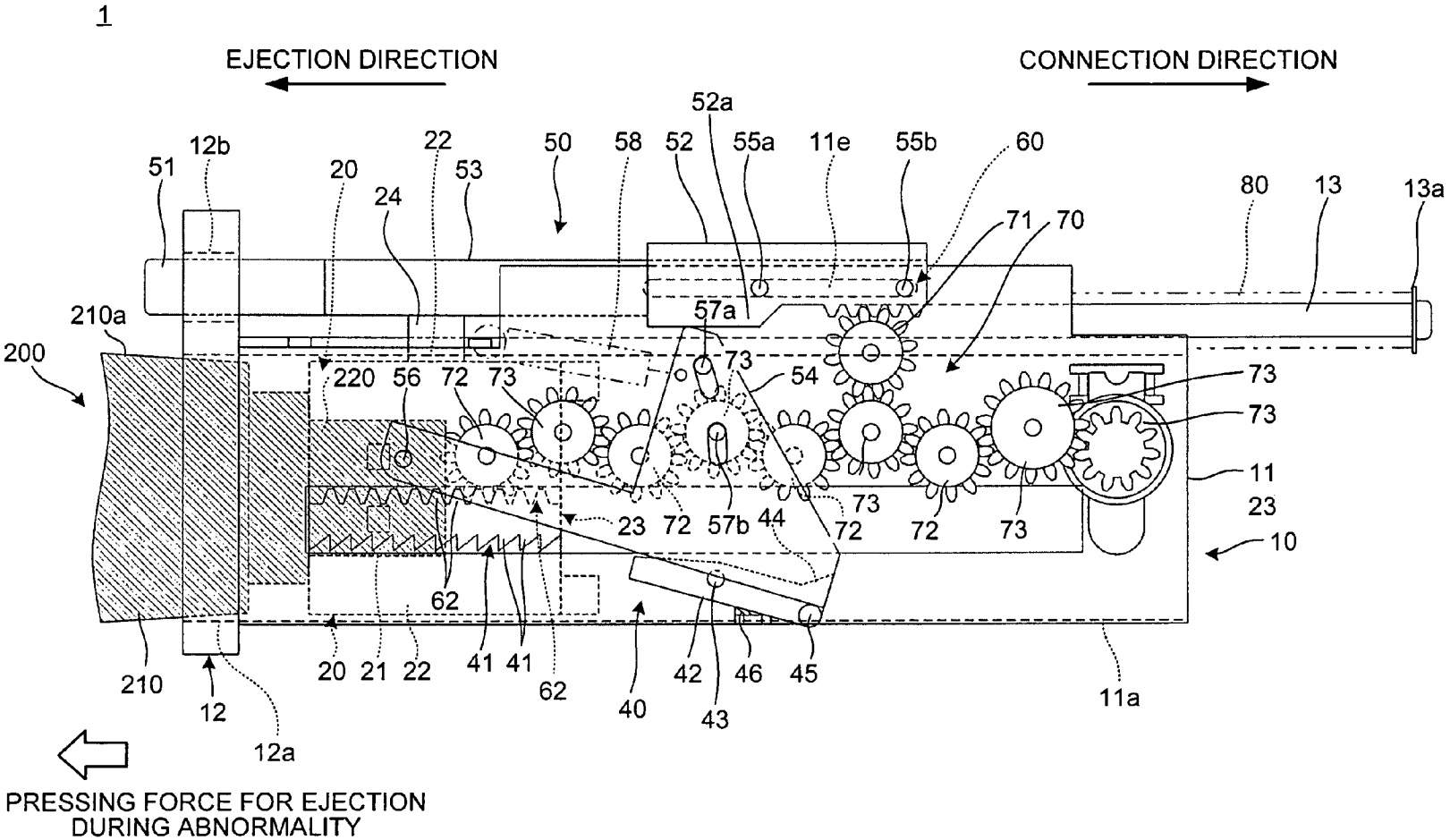
FIG. 14 is a diagram (right lateral view) of a connector housing device after eject during an abnormality.

Next, operations of the connector housing device 1 will be described. FIG. 6 and FIG. 7 are diagrams of the connector housing device when connecting. FIG. 8 and FIG. 9 are diagrams of the connector housing device after connection. FIG. 10 is a diagram of the connector housing device when storing. FIG. 11 is a diagram of the connector housing device when removing. FIG. 12 is a diagram of the connector housing device after eject. FIG. 13 is a diagram of the connector housing device during an abnormal storage. FIG. 14 is a diagram of the connector housing device after eject during an abnormality.

First, as shown in FIG. 1 to FIG. 3, when the receiving-side connector main body 21 and the connecting-side connector 120 of the connecting electronic device 100 are not in contact, the biasing force for eject from the connector biasing unit 80 is applied to the receiving-side connector 20 in the eject direction. Therefore, the receiving-side connector 20 is positioned in the waiting position within the connector storing unit 11 of the main frame 10.

Next, a user inserts the connecting-side connector 120 of the connecting electronic device 100 into the opening 12*a* on the surface 12 of the main frame 10, in a state in which the receiving-side connector 20 is positioned in the waiting position. The connecting-side connector 120 inserted into the opening 12*a* approaches the receiving-side connector 20 in the connection direction to the receiving-side connector 20 and contacts the connecting surface 21*a* of the receiving-side connector main body 21 of the receiving-side connector 20. Furthermore, when the user attempts to insert the connecting electronic device 100 into the opening 12*a* in the connection direction and applies a pressing force when connecting to the connecting-side connector 120 in the connection direction, the receiving-side connector 20 moves in the connection direction from the waiting direction. The connecting-side connector 120 is in contact with the contacting surface 21*a*. The receiving-side connector 20 moves against the biasing force for eject applied to the receiving-side connector 20 in the connection direction.

When the receiving-side connector 20 moves in the connection direction from the waiting position because of the pressing force when connecting, the cam-driving pin 31 and the control pin 32 in the control unit 30 move along the first slit 11*b* and the second slit 11*c* in the connection direction. The cam-driving pin 31 comes into contact with the cam gear teeth 34*c* of the cam 34 through the movement in the connection direction. The cam-driving pin 31 moves further in the connection direction while in contact with the cam gear teeth 34*c*. At this time, as a result of the cam 34 moving the cam rotation control component 38 in a direction opposite of the cam rotation control direction against the biasing force for rotation control in the cam rotation control direction (an arrow C direction in FIG. 3) from the cam biasing unit 36*b*, as shown in FIG. 7, the cam 34 rotates in a rotatable direction (the arrow B direction in FIG. 1). In the cam rotation control component 38, the cam gear teeth 34*b* mesh with the control gear teeth 38*a*.

When the cam 34 is rotated in the rotatable direction by the cam-driving pin 31, the cam 34 rotates the pin lock lever 33 in a direction opposite of the control release direction (the arrow A direction in FIG. 1) by the lever biasing unit 36*a*, until a corner 34*a* farthest from a rotational center of the cam 34 and the pin lock lever 33 come into contact, as shown in FIG. 6. At this time, the control pin 32 is locked by the locking unit 33*a* of the pin lock lever 33 because of the movement in the connection direction. The pin lock lever 33 is rotating in the direction opposite of the control release direction. In other words, when the pressing force when connecting is applied to the connecting-side connector 120, the pin lock lever 33 locks the control pin 32. Therefore, as a result of the pin lock lever 33 locking the control pin 32, the movement of the receiving-side connector 20 in the connection direction is controlled and the receiving-side connector 20 stops at a connecting position. In other words, because of the pressing force when connecting applied to the connecting-side connector 120, the receiving-side connector 20 stops the receiving-side connector 20 moving in the connection direction from the waiting position at the connecting position. At this time, the user can confirm that the movement of the receiving-side connector 20 in the connection direction is controlled by the control unit 30 because resistance occurring when the connecting electronic device 100 is inserted into the opening 12*a* of the surface 12 in the connection direction increases.

The connecting-side connector 120 is in contact with the connecting surface 21*a* of the receiving-side connector 20 that is stopped at the connecting position. Therefore, when the user inserts the connecting electronic device 100 further into the opening 12*a* of the surface 12 against the above-described increased resistance or, in other words, applies further pressing force when connecting to the connecting-side connector 120, the connecting-side connector 120 is inserted into the receiving-side connector main body 21 of the receiving-side connector 20. As a result, as shown in FIG. 6 and FIG. 7, the connecting-side connector 120 and the receiving-side connector 20 are connected. At this time, the user can confirm that the connecting-side connector 120 is connected to the receiving-side connector 20 because the connecting electrical device 100 cannot be inserted into the opening 12*a* of the surface 12 in the connection direction. A reason is because, even when the pressing force when connecting is applied to the connecting-side connector 120 in the connection direction when the connecting-side connector 120 and the receiving-side connector 20 are being connected, the movement of the receiving-side connector 20 in the connection direction is controlled by the control unit 30. In this way, the control unit 30 controls the movement of the receiving-side connector 20 in the connection direction when the connecting-side connector 120 and the receiving-side connector 20 are being connected by the pressing force when connecting being applied to the connecting-side connector 120 in the connection direction. In other words, when the pressing force when connecting is applied to the connecting-side connector 120 in the connection direction when the connecting-side connector 120 and the receiving-side connector 20 are being connected, the control unit 30 controls the movement of the receiving-side connector 20 in the connection direction.

Next, upon confirming the connection between the connecting-side connector 120 and the receiving-side connector 20, the user stops the insertion of the connecting electronic device into the opening 12*a* of the surface 12 in the connection direction by, for example, removing his or her hand from the connecting electronic device 100. As a result, the pressing force when connecting is not applied to the connecting-side connector 120 connected to the receiving-side connector 20. The receiving-side connector 20 returns from the connecting position to the waiting position, as shown in FIG. 8 and FIG. 9, by the biasing force for eject in the eject direction applied by the connector biasing unit 80. At this time, the cam-driving pin 31 moves in the eject direction when the receiving-side connector 20 moves from the connecting position to the waiting position. When the cam-driving pin 31 moves in the eject direction, the cam 34 also attempts to rotate in the direction opposite of the rotatable direction because the cam gear teeth

34*b* is in contact with the cam-driving pin 31. However, because the cam gear teeth 34*c* of the cam 34 mesh with the control gear teeth 38*a* of the cam rotation control component 38, the cam 34 cannot rotate in the direction opposite of the rotatable direction. Therefore, the cam-driving pin 31 fights the biasing force for rotation control in the cam rotation control direction (an arrow C direction in FIG. 7) from the cam biasing unit 36*b*, in an attempt to move in the eject direction. The cam-driving pin 31 presses the cam gear teeth 34*a*, and the cam 34 and the cam rotation control component 38 move in the direction opposite of the cam rotation controlling direction. As a result, the cam-driving pin 31 moves in the eject direction without rotating the cam 34.

Next, in a state in which a post-connection receiving-side connector 20 to which the connecting-side connector 120 is connected is positioned in the waiting position, the user inserts the connecting electronic device 100 into the opening 12*a* on the surface 12 of the main frame again. The user applies again a pressing force when storing to the post-connection receiving-side connector 20, via the connecting-side connector 120. The pressing force when storing is applied in the internal direction of the main frame 10 or, in other words, in the same direction as the connection direction. When the post-connection receiving-side connector 20 moves in the connection direction from the waiting position because of the pressing force when storing, the cam-driving pin 31 comes into contact with the cam gear teeth 34*c* of the cam again, as a result of the movement in the connection direction. The cam-driving pin 31 moves further in the connection direction while in contact with the cam gear teeth 34*c* again. As described above, the cam 34 rotates in the rotatable direction (an arrow B direction in FIG. 8). When the cam 34 is rotated in the rotatable direction by the cam-driving pin 31, the contact between the corner 34*a* of the cam 34 and the pin lock lever 33 is broken. The pin lock lever 33 rotates in the control release direction (the arrow A direction in FIG. 1) by the lever biasing unit 36*a*. Therefore, even when the control pin 32 moves in the connection direction, the control pin 32 is not locked by the locking unit 33*a* of the pin lock lever 33. As a result, when the pressing force when storing is applied again, control of the movement of the post-connection receiving-side connector 20 in the connection direction is released.

When the connection direction and the internal direction of the main frame 10 are the same, and the user applies a pressing force to the connecting-side connector 120 of the connecting electronic device 100 and connects the connecting-side connector 120 and the receiving-side connector 20, as described above, the user can confirm that the connecting-side connector 120 is connected to the receiving-side connector 20 because the movement of the receiving-side connector 20 in the connection direction is controlled by the control unit 30 and the connecting electronic device 100 cannot be inserted into the opening 12*a* on the surface 12. As a result, before storing the post-connection receiving-side connector 20 in the main frame 10, the user can confirm the connection between the connecting-side connector 120 and the receiving-side connector 20.

When the pressing force when connecting is applied to the connecting-side connector 120 in the connection direction, as described above, the cam 34 of the control unit 30 rotates by a predetermined angle until the pin lock lever 33 and the corner 34*a* of the cam 34 come into contact. When the pressing force when storing is applied again to the connecting-side connector 120 in the connection direction, the cam 34 rotates by a predetermined angle until the contact between the pin lock lover 33 and the corner 34*a* of the cam 34 is broken. In other words, by the cam 34 rotating by a predetermined angle every time the pressing force is applied to the connecting-side connector 120 in the connection direction, the locking of the control pin 31 and the release of the locking by the pin lock lever 33 are repeated. Therefore, if the pressing force when storing is applied again in the connection direction to the post-connection connecting-side connector to which the receiving-side connector 20 is connected, when the connection between the connecting-side connector 120 and the receiving-side connector 20 is completed after the connecting-side connector 120 and the receiving-side connector 20 are connected, the control unit 30 releases the control by the control unit 30. As described above, the control unit 30 repeats the control and release of the movement of the receiving-side connector 20 in the connection direction, every time the pressing force is applied to the connecting-side connector 120 in the connection direction.

Next, the user inserts the connecting electronic device 100 further into the opening 12*a* on the surface 12 of the main frame 10. The user further applies the pressing force when connecting to the post-connection receiving-side connector 20, via the connecting-side connector 120. The pressing force when connecting is applied in the internal direction of the main frame or, in other words, in the same direction as the connection direction. As a result, the post-connection receiving-side connector 20 moves in the connection direction from the waiting position because of the pressing force when connecting. Then, the rack component 23 moves in the connection direction along the third slit 11*d*. The holding gear teeth 41*a* that is closest to the connection direction side of the holding rack 41 in the holding unit 40 and the holding protrusion 44 on the rack lock arm 42 mesh. As a result, the holding rack 41 is locked by the rack lock arm 42, and the movement of the holding rack 41 in the eject direction is controlled. Therefore, when the user, for example, removes his or her hand from the connecting electronic device 100 and stops inserting the connecting electronic device 100 into the opening 12*a* on the surface 12 in the connection direction, the connecting electronic device 100 is held by the holding unit 40 in the holding position. The holding position is the arbitrary position to which the connecting electronic device has moved. In other words, the holding unit 40 controls the movement in the connection direction of the post-connection receiving-side connector 29 to which the connecting-side connector 120 has been connected and holds the post-connection receiving-side connector 20 in the holding position. As a result, the post-connection receiving-side connector 20 and a portion of the connecting electronic device main body 110 are housed within the main frame 10. Therefore, a portion of the connecting electronic device 100 that is positioned outside of the electronic device can be reduced. A risk of the user mistakenly coming into contact with the connecting electronic device 100 can be suppressed. Vibrations and trauma to the connecting electronic device 100 can be suppressed. As a result, faulty connection between the connecting-side connector 120 and the receiving-side connector 20 after the connecting-side connector 120 and the receiving-side connector 20 are connected can be suppressed.

When the user inserts the connecting electronic device 100 further into the opening 12*a* on the surface 12 of the main frame 10 while the post-connection receiving-side connector 20 is held by the holding unit 40, the holding rack 41 attempts to move in the connection direction because of the pressing force when storing applied to the post-connection receiving-side connector 20 in the connection direction, via the connecting-side connector 120. Therefore, the rack lock arm 42 rotates in a direction opposite of the holding direction against the biasing force for holding applied to the rack lock arm 42 that is locking the holding rack 41. The biasing force for holding is applied in the holding direction by the art biasing unit 46. The holding protrusion 44 on the rack lock arm 42 moves over the holding gear teeth 41*a* of the holding rack 41 with which the holding protrusion 44 meshed and meshes with the holding gear teeth 41*a* that is adjacent in the connection direction. Therefore, by the pressing force when storing being continuously applied, in the holding unit 41 is held by the rack lock arm 42 while the holding rack 41 moves in the connection direction, as shown in FIG. 10. In other words, the holding unit 40 holds the post-connection receiving-side connector that has moved in the connection direction in the holding position, depending on the pressing force when storing. The holding position is the arbitrary position to which the receiving-side connector has moved. As a result, by continuously applying the pressing force when storing, the user can change a storing range of the connecting electronic device 100 housed within the main frame. The user can decide a storing range over which the connecting electronic device 100 is housed within the main frame 10 depending on the shape of the main frame 10.

For example, when the connecting electronic device 100 of which the connection between the connecting electronic device 100 and the receiving-side connector 20 easily becomes faulty is housed, the connecting electronic device 100 can be inserted into the main frame 10 until the entire connecting electronic device 100 is housed in the main frame 10. In addition, for example, when the connecting electronic device 100 of which the connection between the connecting electronic device 100 and the receiving-side connector 20 easily becomes faulty is housed, the connecting electronic device 100 can be inserted into the main frame 10 until the entire connecting electronic device 100 is housed in the main frame 10.

Next, when removing the connecting electronic device 100 housed in the connector housing device 1, the user presses the eject button 51 in the connection direction, and the button pressing force is applied to the eject button 51. As a result of the button pressing force, the eject button 51 moves in the connection direction against the return biasing force in the eject direction applied to the releasing and removing component 52 by the button biasing unit 59. In addition to the eject button 51, the releasing and removing component 52 attached by the attachment arm 53 also moves in the connection direction. Then, as shown in FIG. 11, the hold releasing arm 54 moves onto the step 52*a* of the releasing and removing component 52 moving in the connection direction. By moving onto the step 52*a*, the hold releasing arm 54 rotates in the direction opposite of the hold releasing direction, against the biasing force for hold releasing applied in the hold releasing direction (an arrow E direction in FIG. 11) by the arm biasing unit 58. The rack lock arm 42 that is in constant contact with the hold releasing arm 54 by the hold releasing pin 45 rotates in the direction opposite of the hold releasing direction, against the biasing force for hold releasing applied in the holding direction (an arrow D direction in FIG. 11) by the arm biasing unit 46. As a result, the meshing between the holding protrusion 44 of the rack lock arm 42 and the holding gear teeth 41*a* of the holding rack 41 is released. The locking of the holding rack 41 by the rack lock arm 42 is released. In other words, the hold releasing unit 50 releases the hold placed by the holding unit 40 by the eject button 51 moving in the connection direction.

In a state in which the hold placed by the holding unit 40 is released, only the biasing force for eject from the connector biasing unit 80 is applied to the post-connection receiving-side connector 20 in the eject direction. The eject direction is the direction in which the post-connection receiving-side connector 20 moves from the holding position to the waiting position. Therefore, the post-connection receiving-side connector 20 moves in the eject direction, as shown in FIG. 12, with the connecting electronic device 100. The connecting electronic device 100 includes the connecting-side connector 120 connected to the receiving-side connector 20. Then, the post-connection receiving-side connector 20 moves to the waiting position and stops. As a result, the connecting electronic device 100 can be removed from the connector housing device 1. By pulling the connecting electronic device 100 in the eject direction, the user can remove the connecting-side connector 120 from the receiving-side connector main body 21 of the receiving-side connector 20 in the waiting position. The user can break the electric connection between the connecting electronic device 100 and the electronic device.

The connector housing device 1 according to the embodiment can house the connecting electronic device 100 having a popular shape as the connection-subject and remove the connecting electronic device 100 by the hold releasing unit 50. However, the user may mistakenly attempt to insert and house a non-standard connecting electronic device 200 that cannot be housed in the connector housing device 1. FIG. 13 is a diagram (right lateral view) of the connector housing device during an abnormal storage. FIG. 14 is a diagram (right lateral view) of the connector housing device after eject during an abnormality. When the non-standard connecting electronic device 200 is inserted into the opening 12*a* on the surface 12 in the connection direction, the connection between a connecting-side connector 220 and the receiving-side connector 20 can be performed by the control unit 30, as shown in FIG. 13. However, when the control unit 30 is released, the pressing force for storage is applied to the post-connection receiving-side connector 20 in the connection direction, and a connecting electronic device main body 210 is moved in the connection direction with the post-connection receiving-side connector 20, an outer periphery 210*a* of the connecting electronic device main body 210 interferes with the opening 12*a*. The non-standard connecting electronic device 200 may not be able to be inserted in the connection direction any further. Then, even when the biasing force for eject is applied to the post-connection receiving-side connector 20 in the eject direction by the connector biasing unit 80, the non-standard connecting electronic device 200 cannot be removed from the connector housing device 1 because the outer periphery 210*a* of the non-connecting electronic device main body 210 is interfering with the opening 12*a*. In other words, the receiving-side connector 20 of which the hold placed by the holding unit 40 has been released may not reach the waiting position because of the biasing force for eject in the eject direction by the connector biasing unit 80. The user removes the non-standard connecting electronic device 200 from the connector housing device 1 using the pressing-force applying unit 60.

The user presses the eject button 51 in the connection direction, and the button pressing force is applied to the eject button 51 in the connection direction. As a result of the button pressing force, the releasing and removing component 52 moves in the connection direction with the eject button 51. The hold placed by the holding unit 40 is released by the hold releasing unit 50. Then, as a result of the user further applying the button pressing force in the connection direction on the eject button 51, the releasing and removing component 52 moves in the connection direction with the eject button 51. Then, the button-side ejecting rack 61*a* in the button-side ejecting rack 61 of the pressing-force applying unit 60 and the drive gear 71 of the gear unit 70 mesh. When the releasing and removing component 52 moves further in the connection direction with the eject button 51, the drive gear 71 is rotated in the eject side rotational direction (an arrow F direction in FIG. 13) of the drive gear 71 by the button-side ejecting rack 61 moving in the connection direction because of the button pressing force.

The eject gears 72 rotate in the eject side rotational direction (an arrow G direction in FIG. 13) by the rotational force of the drive gear 71 transmitted by the transmission gear 73. The connector-side removing gear teeth 62*a* of the connector-side ejecting rack 62 always meshes with any one of the eject gears 72. Therefore, the rotational force of the eject gear 72 is transmitted to the connector-side ejecting rack 62 and becomes the pressing force for eject that moves the post-connection receiving-side connector 20 in the eject direction. The receiving-side connector 20 includes the rack component 23 onto which the connector-side ejecting rack 62 is formed. Therefore, the pressing force for eject is applied to the post-connection receiving-side connector 20 to which the connecting-side connector 220 of the non-standard connecting electronic device 200 is connected. As shown in FIG. 14, the post-connection receiving-side connector 20 can move in the eject direction. In other words, the pressing-force applying unit 60 converts the button pressing force in the connection direction applied to the eject button 51 by the user to the pressing force for eject in the eject direction.

When the outer periphery 210*a* of the non-connecting electronic device main body 210 and the opening 12*a* stop interfering by the post-connection receiving-side connector 20 being moved in the eject direction by the pressing force for eject, the holding unit 40 is released by the hold releasing unit 50. Therefore, the post-connection receiving-side connector 20 moves to the waiting position and stops because of the pressing force for eject. The pressing force for eject is applied to the post-connection receiving-side connector 20 in the eject direction by the connector biasing unit 80. As a result, the non-standard connecting electronic device 200 can be removed from the connector housing device 1.

As described above, the connecting electronic device 100 of which the storage is permitted by the connector housing device 1 is removed by the hold releasing unit 50 releasing the hold placed by the holding unit 40. The non-standard connecting electronic device 200 of which the storage is not permitted by the connector housing device 1 is removed by the pressing-force applying unit 60 converting the button pressing force to the pressing force for eject. Therefore, regardless of whether the connector housing device 1 permits the storage, the connecting electronic device (the connecting electronic device 100 and the non-standard connecting electronic device 200) housed in the connector housing device 1 can be removed with certainty.

When the user does not apply the button pressing force to the eject button 51 in the connection direction, the eject button 51 moves in the eject direction because of the return biasing force in the eject direction applied to the releasing and removing component 52 from the button biasing unit 59 and stops in the normal position. Therefore, when the user further applies the button pressing force to the eject button 51 that has returned to the normal position, the button-side ejecting rack and the drive gear 71 mesh again. The button pressing force is converted to the pressing force for eject again by the pressing-force applying unit 60. The post-connection receiving-side connector 20 moves in the eject direction again because of the pressing force for eject. In other words, the pressing-force applying unit 60 applies the pressing force for eject to the post-connection receiving-side connector 20 every time the button pressing force is repeatedly applied to the eject button 51. As a result of the pressing force for eject during an abnormality, the post-connection receiving-side connector 20 can be moved in the eject direction. Therefore, the post-connection receiving-side connector 20 can be repeatedly moved in the eject direction until the non-standard connecting electronic device 200 is removed from the connector housing device 1. For example, if the outer periphery 210*a* of the non-connecting electronic device main body 210 and the opening 12*a* are still interfering when the pressing force during an abnormality is merely applied once to the post-connection receiving-side connector 20, the post-connection receiving-side connector 20 can be moved in the eject direction until the interference is eliminated by the user repeatedly applying the button pressing force to the eject button 51.

According to the above-described embodiment, the surface 12 can include a light-emitting unit, such as a lamp or a light-emitting diode (LED). The light-emitting unit emits light in conjunction with the connecting-side connector 120 and the receiving-side connector 20 being connected or, in other words, the connecting electronic device 100 and the electronic device being electrically connected. In other words, a connection output unit, such as the light-emitting unit, that externally outputs the electric connection between the connecting electronic device 100 and the electronic device can be provided. As a result, the user can confirm the connection between the connecting-side connector 120 and the receiving-side connector 20 not only by through sensation when inserting the connecting electronic device 100 into the main frame, but also visually. Therefore, the connection between the connecting-side connector 120 and the receiving-side connector 20 can be confirmed with further certainty, before the post-connection receiving-side connector 20 is housed in the main frame 10. The connection output unit is not limited to the light-emitting unit. The connection output unit can be a voice-output unit that outputs a voice when the connecting-side connector 120 and the receiving-side connector 20 are connected, a vibrating unit that generates a vibration, or the like. An external output unit can be provided on a surface of the electronic device, rather than on the surface 12 of the main frame 10.

INDUSTRIAL APPLICABILITY

As described above, the connector housing device and the electronic device of the present invention are effective in a connector housing device and an electronic device including a receiving-side connector, represented by the USB standard, allowing an electric connection with another electronic device. In particular, the connector housing device and the electronic device of the present invention are suitable for secure eject of a connecting electronic device that is housed.

The invention claimed is:

1. A connector housing device comprising:

a receiving-side connector to which a connecting-side connector is connected from outside;

a main frame that supports the receiving-side connector to which the connecting-side connector is connected, in such a manner that the receiving-side connector moves to an inside of the main frame;

a holding unit that holds the receiving-side connector that is moved to the inside with respect to the main frame;

a connector biasing unit that applies a biasing force in a direction of an outside of the main frame to the receiving-side connector;

a hold releasing unit that releases a hold placed by the holding unit, and moves the receiving-side connector to the outside by the biasing force; and a pressing-force applying unit that applies, when the receiving-side connector is not moved by the biasing force after the hold on the receiving-side connector is released, a pressing force for ejecting the receiving-side connector to the receiving-side connector.

2. The connector housing device according to claim 1, wherein the hold releasing unit includes a hold releasing button that is supported to be moved to the inside with respect to the main frame; and a hold releasing arm that is supported by the main frame in a pivotable manner, and releases the hold when the hold releasing button is moved to the inside.

3. The connector housing device according to claim 1, wherein the pressing-force applying unit includes an abnormal ejecting button that is supported to move be moved to the inside with respect to the main frame; and a pressing-force converting unit that converts a pressing force on the abnormal ejecting button toward the inside into the pressing force for ejecting the receiving-side connector.

4. The connector housing device according to claim 3, wherein the pressing-force converting unit applies the pressing force for ejecting the receiving-side connector to the receiving-side connector each time the abnormal ejecting button is repeatedly pressed by the button pressing force.

5. The connector housing device according to claim 3, wherein the pressing-force converting unit includes a button-side ejecting rack that is provided on the abnormal ejecting button;

a connector-side ejecting rack that is provided on the receiving-side connector; and a gear unit that is supported by the main frame in a pivotable manner, and engages with the button-side ejecting rack and the connector-side ejecting rack.

6. The connector housing device according to claim 3, wherein the hold releasing button is same as the abnormal ejecting button.

7. An electronic device comprising:

a connector housing device that includes a receiving-side connector to which a connecting-side connector is connected from outside;

a main frame that supports the receiving-side connector to which the connecting-side connector is connected, in such a manner that the receiving-side connector moves to an inside of the main frame, a holding unit that holds the receiving-side connector that is moved to the inside with respect to the main frame, a connector biasing unit that applies a biasing force in a direction of an outside of the main frame to the receiving-side connector, a hold releasing unit that releases a hold placed by the holding unit, and moves the receiving-side connector to the outside by the biasing force, and a pressing-force applying unit that applies, when the receiving-side connector is not moved by the biasing force after the hold on the receiving-side connector is released, a pressing force for ejecting the receiving-side connector to the receiving-side connector, wherein the electronic device is electrically connected with a connecting electronic device including the connecting-side connector by connecting the receiving-side connector and the connecting-side connector.

8. A connector housing device comprising:

a receiving-side connector to which a connecting-side connector is connected from outside;

a main frame that supports the receiving-side connector in such a manner that the receiving-side connector moves between a waiting position at which the connecting-side connector is connected to the receiving-side connector and a holding position at which the connecting-side connector is kept in a connected state;

a connector biasing unit that applies a biasing force in an ejecting direction from the holding position to the waiting position to the receiving-side connector; and a pressing-force applying unit that applies, when the receiving-side connector is not moved by the biasing force after a hold on the receiving-side connector is released, a pressing force for ejecting the receiving-side connector to the receiving-side connector.

9. An electronic device comprising:

a connector housing device that includes a receiving-side connector to which a connecting-side connector is connected from outside;

a main frame that supports the receiving-side connector in such a manner that the receiving-side connector moves between a waiting position at which the connecting-side connector is connected to the receiving-side connector and a holding position at which the connecting-side connector is kept in a connected state;

a connector biasing unit that applies a biasing force in an ejecting direction from the holding position to the waiting position to the receiving-side connector; and a pressing-force applying unit that applies, when the receiving-side connector is not moved by the biasing force after a hold on the receiving-side connector is released, a pressing force for ejecting the receiving-side connector to the receiving-side connector, wherein the electronic device is electrically connected with a connecting electronic device including the connecting-side connector by connecting the receiving-side connector and the connecting-side connector.

* * * * *